US008524336B2

(12) United States Patent
Oguri et al.

(10) Patent No.: US 8,524,336 B2
(45) Date of Patent: Sep. 3, 2013

(54) RECORDING MEDIUM

(75) Inventors: Isamu Oguri, Yokohama (JP); Hisao Kamo, Ushiku (JP); Yasuhiro Nito, Yokohama (JP); Tetsuro Noguchi, Hachioji (JP); Ryo Taguri, Sagamihara (JP); Olivia Herlambang, Kawasaki (JP); Naoya Hatta, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/090,439

(22) Filed: Apr. 20, 2011

(65) Prior Publication Data

US 2011/0293860 A1 Dec. 1, 2011

(30) Foreign Application Priority Data

May 31, 2010 (JP) ..... 2010-125238

(51) Int. Cl.
*B41M 5/50* (2006.01)

(52) U.S. Cl.
USPC ..... 428/32.25; 428/212

(58) Field of Classification Search
USPC ..... 428/32.35, 212
See application file for complete search history.

(56) References Cited

U.S. PATENT DOCUMENTS

| | | | | |
|---|---|---|---|---|
| 4,434,226 | A | 2/1984 | Wilgus et al. | |
| 5,635,291 | A | 6/1997 | Yoshino et al. | |
| 5,800,916 | A | 9/1998 | Yoshino et al. | |
| 5,846,647 | A | 12/1998 | Yoshino et al. | |
| 5,851,654 | A | 12/1998 | Yoshino et al. | |
| 5,869,177 | A | 2/1999 | Yoshino et al. | |
| 5,955,185 | A | 9/1999 | Yoshino et al. | |
| 5,962,124 | A | 10/1999 | Yoshino et al. | |
| 5,965,252 | A | 10/1999 | Santo et al. | |
| 6,187,419 | B1 | 2/2001 | Kijimuta et al. | |
| 6,335,085 | B1 * | 1/2002 | Asano et al. | 428/32.25 |
| 6,342,289 | B1 | 1/2002 | Eguchi et al. | |
| 6,436,513 | B1 | 8/2002 | Kitamura et al. | |
| 6,558,740 | B1 | 5/2003 | Santo et al. | |
| 6,649,661 | B2 | 11/2003 | Yoshino et al. | |
| 6,709,097 | B2 | 3/2004 | Nakahara et al. | |
| 6,874,881 | B2 | 4/2005 | Suzuki et al. | |
| 6,929,362 | B2 | 8/2005 | Takada et al. | |
| 6,932,465 | B2 | 8/2005 | Nito et al. | |
| 6,935,732 | B2 | 8/2005 | Takada et al. | |
| 7,029,109 | B2 | 4/2006 | Shirota et al. | |
| 7,055,943 | B2 | 6/2006 | Suzuki et al. | |
| 7,144,613 | B2 | 12/2006 | Eguchi et al. | |
| 7,208,032 | B2 | 4/2007 | Hakamada et al. | |
| 7,276,110 | B2 | 10/2007 | Tsujimura et al. | |
| 7,276,112 | B2 | 10/2007 | Tokuda et al. | |
| 7,347,890 | B2 | 3/2008 | Nito et al. | |
| 7,354,145 | B2 | 4/2008 | Nito et al. | |
| 7,377,631 | B2 | 5/2008 | Takada et al. | |
| 7,402,200 | B2 | 7/2008 | Imai et al. | |
| 7,416,639 | B2 | 8/2008 | Yoshino et al. | |
| 7,517,073 | B2 | 4/2009 | Nito et al. | |
| 7,517,074 | B2 | 4/2009 | Hakamada et al. | |
| 7,537,329 | B2 | 5/2009 | Nito et al. | |
| 7,625,614 | B2 | 12/2009 | Kamo et al. | |
| 7,635,182 | B2 | 12/2009 | Hakamada et al. | |
| 7,846,516 | B2 | 12/2010 | Kamo et al. | |
| 7,867,586 | B2 | 1/2011 | Kamo et al. | |
| 8,142,849 | B2 | 3/2012 | Ohshima et al. | |
| 2003/0228429 | A1 | 12/2003 | Ercoli et al. | |
| 2004/0180153 | A1 | 9/2004 | Usami et al. | |
| 2005/0106317 | A1 | 5/2005 | Shino | |
| 2008/0152827 | A1 | 6/2008 | Hakamada et al. | |
| 2009/0123676 | A1 * | 5/2009 | Kato et al. | 428/32.25 |
| 2010/0075046 | A1 | 3/2010 | Hakamada et al. | |
| 2011/0008553 | A1 | 1/2011 | Hyakuda et al. | |
| 2011/0076427 | A1 | 3/2011 | Hyakuda et al. | |
| 2011/0104411 | A1 | 5/2011 | Oguri et al. | |
| 2011/0135855 | A1 | 6/2011 | Oguri et al. | |

FOREIGN PATENT DOCUMENTS

| | | | |
|---|---|---|---|
| CN | 1530946 | A | 9/2004 |
| CN | 1616244 | A | 5/2005 |
| CN | 101346241 | A | 1/2009 |
| EP | 0 891 873 | A2 | 1/1999 |
| EP | 1 243 436 | A1 | 9/2002 |
| EP | 1 531 057 | A2 | 5/2005 |
| JP | 58-113927 | A | 7/1983 |
| JP | 5-016015 | B2 | 3/1993 |
| JP | 7-232473 | A | 9/1995 |
| JP | 8-132731 | A | 5/1996 |
| JP | 08-324098 | A | 12/1996 |
| JP | 9-066664 | A | 3/1997 |
| JP | 9-076628 | A | 3/1997 |
| JP | 2883299 | B2 | 4/1999 |
| JP | 2004-009734 | A | 1/2004 |

OTHER PUBLICATIONS

Sep. 7, 2011 European Search Report in European Patent Appln. No. 11003612.6.

Chinese Office Action dated May 3, 2013, in counterpart Chinese Application No. 201110144339.5.

Korean Office Action dated Jun. 10, 2013, issued in counterpart Korean Application No. 10-2011-0048445.

* cited by examiner

*Primary Examiner* — Gerard Higgins
*Assistant Examiner* — Sathavaram I Reddy
(74) *Attorney, Agent, or Firm* — Fitzpatrick, Cella, Harper & Scinto

(57) ABSTRACT

The invention provides a recording medium having excellent ink absorbency and capable of forming a sharp image thereon. The recording medium has a substrate, and a first layer and an outermost layer provided on the substrate in this order, wherein the first layer contains at least one of alumina and alumina hydrate, the outermost layer contains a pigment and is lower in refractive index than the first layer, and the absolute dry coating amount of the outermost layer is 0.1 $g/m^2$ or more and 0.5 $g/m^2$ or less.

3 Claims, No Drawings

RECORDING MEDIUM

BACKGROUND OF THE INVENTION

1. Field of the Invention

The present invention relates to a recording medium.

2. Description of the Related Art

A recording medium having an ink receiving layer on a substrate is known as a recording medium. Such an ink receiving layer is known to contain alumina or alumina hydrate as a pigment (see Japanese Patent Application Laid-Open No. 2004-009734).

When alumina or alumina hydrate is used as the pigment in the ink receiving layer like the recording medium described in Japanese Patent Application Laid-Open No. 2004-009734, the ink receiving layer can be formed with a binder in an amount smaller than that in the case where silica is used, so that it is easy to form an ink receiving layer having excellent ink absorbency.

Alumina or alumina hydrate is high in refractive index compared with silica. Therefore, surface reflection on the surface of the ink receiving layer becomes great, and so it is easy to achieve high glossiness.

However, the investigation by the present inventors has revealed that an image of a dark color tone such as a black image looks whitish on the outside or in a bright room in particular and is liable to become an image without sharpness.

SUMMARY OF THE INVENTION

Accordingly, it is an object of the present invention to provide a recording medium having excellent ink absorbency and capable of forming a sharp image thereon.

In order to achieve the above object, the present invention provides a recording medium comprising a substrate, and a first layer and an outermost layer provided on the substrate in this order, wherein the first layer contains at least one of alumina and alumina hydrate, the outermost layer contains a pigment and is lower in refractive index than the first layer, and the absolute dry coating amount of the outermost layer is 0.1 $g/m^2$ or more and 0.5 $g/m^2$ or less.

According to the present invention, a recording medium having excellent ink absorbency and capable of forming a sharp image thereon can be provided.

Further features of the present invention will become apparent from the following description of exemplary embodiments.

DESCRIPTION OF THE EMBODIMENTS

Preferred embodiments of the present invention will now be described in detail. Incidentally, the present invention is not interpreted as being limited to these descriptions.

The recording medium according to the present invention is a recording medium having a substrate, and a first layer and an outermost layer provided on the substrate in this order. The first layer favorably adjoins the outermost layer. The recording medium according to the present invention can be used as a recording medium for conducting recording with a felt-tip pen or a recording medium used in ink jet recording.

Substrate

As the substrate of the present invention, may be favorably used paper such as cast-coated paper, baryta paper or resin-coated paper (resin-coated paper with both surfaces thereof coated with a resin such as polyolefin). In addition, a transparent thermoplastic film formed of polyethylene, polypropylene, polyester, polylactic acid, polystyrene, polyacetate, polyvinyl chloride, cellulose acetate, polyethylene terephthalate, polymethyl methacrylate or polycarbonate may be favorably used. Besides the above, waterleaf paper or coat paper that is moderately sized paper, or a sheet-like material (synthetic paper or the like) formed of a film opacified by filling an inorganic material or by fine foaming may also be used. In addition, a sheet formed of glass or metal may also be used. Further, the surfaces of these substrates may also be subjected to a corona discharge treatment or various undercoating treatments for the purpose of improving adhesion strength between such a substrate and the layer formed thereon. Among the above-described substrates, the resin-coated paper is favorably used from the viewpoint of a glossy feeling of the resulting recording medium.

First Layer

The first layer of the present invention contains at least one of alumina and alumina hydrate. Since at least one of alumina and alumina hydrate is contained, the first layer is good in ink absorbency.

The alumina hydrate is represented by the following general formula (1)

$$Al_2O_{3-n}(OH)_{2n}.mH_2O \qquad \text{General formula (1)}$$

(in the formula, n is any one of 0, 1, 2 and 3, and m is a number of 0 or more and 10 or less, favorably 0 or more and 5 or less. In many cases, $mH_2O$ represents an aqueous phase, which does not participate in the formation of a crystal lattice, but is eliminable, and so m may take a value other than the integer. When the alumina hydrate is calcined, m may take a value of 0. However, m and n are not 0 at the same time.)

Among alumina hydrates, alumina hydrate exhibiting a boehmite structure or amorphous structure when analyzed by the X-ray diffractometry is favorable. As specific examples thereof, may be mentioned the alumina hydrates described in Japanese Patent Application Laid-Open No. H07-232473, Japanese Patent Application Laid-Open No. H08-132731, Japanese Patent Application Laid-Open No. H09-66664 and Japanese Patent Application Laid-Open No. H09-76628. Specific examples of the shape of the alumina hydrate used in the present invention include undefined, spherical and plate forms. Alumina hydrate having any one of these forms may be used, and those having different forms may be used in combination. In particular, alumina hydrate having a number average particle size of primary particles of 5 nm or more and 50 nm or less is favorable, and plate-like alumina hydrate having an aspect ratio of 2 or more is favorable. The aspect ratio can be determined according to the method described in Japanese Patent Publication No. H05-16015. More specifically, the aspect ratio is expressed by a ratio of "diameter" to "thickness" of a particle. Here, the term "diameter" means a diameter (equivalent circle diameter) of a circle having an area equal to a projected area of the particle, which has been obtained by observing the alumina hydrate through a microscope or electron microscope. Alumina hydrate having a specific surface area of 100 $m^2/g$ or more and 200 $m^2/g$ or less as calculated by the BET method is favorably used, and alumina hydrate having a BET specific surface area of 125 $m^2/g$ or more and 175 $m^2/g$ or less is more favorably used. The BET method is a method for measuring the surface area of powder by a gas-phase adsorption method, and is a method for determining a total surface area of 1 g of a sample, i.e., a specific surface area, from an adsorption isotherm. In the BET method, nitrogen gas is generally used as an adsorption gas, and a method of measuring an adsorption amount from a change in the pressure or volume of the gas to be adsorbed is oftenest used. At this time, the Brunauer-Emmett-Teller equation is most marked as that indicating the isotherm of multimolecular adsorption, called the BET equation and widely used in determination of the specific surface area. According to the BET method, the specific surface area is determined by finding an adsorption amount based on the BET equation and multiplying this value by an area occupied by a molecule adsorbed at the surface. In the BET method, the relationship between a certain relative pressure and an absorption amount is determined with several measurement points, and the slope and intercept of the plots thereof are found by the method of least squares to derive the specific surface area. In the present invention, the relationship between the relative pressure and the absorption amount is determined with 10 measurement points to calculate the specific surface area. The alumina hydrate favorably has a pore volume of 0.5 ml/g or more and 1.5 ml/g or less.

The alumina hydrate can be prepared according to a publicly known process such as a process of hydrolyzing an aluminum alkoxide or a process of hydrolyzing sodium aluminate. The alumina hydrate can also be prepared by a publicly known process in which an aqueous solution of aluminum sulfate or aluminum chloride is added to an aqueous solution of sodium aluminate to conduct neutralization. Specific examples of the alumina hydrate suitable for use in the present invention include alumina hydrates showing a boehmite structure or amorphous structure when analyzed by the X-ray diffractometry and described in Japanese Patent Application Laid-Open No. H07-232473, Japanese Patent Application Laid-Open No. H08-132731, Japanese Patent Application Laid-Open No. H09-66664 and Japanese Patent Application Laid-Open No. H09-76628. In addition, commercially available alumina hydrate (trade name: DISPERAL HP14, product of Sasol Co.) may be mentioned as a specific example of the alumina hydrate.

Examples of the alumina include γ-alumina, α-alumina, δ-alumina, θ-alumina and χ-alumina. Among these, γ-alumina synthesized by a gas phase process is favorable from the viewpoints of color developability and ink absorbency. The γ-alumina is obtained by heating and baking alumina hydrate prepared according to a publicly known process at a temperature of 400° C. or more and 900° C. or less.

The alumina hydrate and alumina described above may be used in combination. More specifically, the alumina hydrate and alumina are mixed and dispersed in a state of powder to prepare a dispersion. An alumina hydrate dispersion and an alumina dispersion may also be mixed for use.

In particular, the combined use of the alumina hydrate and the γ-alumina synthesized by the gas phase process is favorably because the ink absorbency of the resulting first layer becomes very good. The mixing mass ratio is favorably 50:50 to 95:5, more favorably 70:30 to 90:10 in terms of (alumina hydrate):(γ-alumina synthesized by the gas phase process).

The first layer favorably contains a binder. The binder is favorably a material which has the ability to bind the alumina hydrate and/or the alumina and form a coating film and does not impair the effects of the present invention. Examples of the binder including the following binders: starch derivatives such as oxidized starch, etherified starch and phosphoric acid-esterified starch; cellulose derivatives such as carboxymethyl cellulose and hydroxyethyl cellulose; casein, gelatin, soybean protein and polyvinyl alcohol and derivatives thereof; polyvinyl pyrrolidone; maleic anhydride resins; latexes of conjugated polymers such as styrene-butadiene copolymers and methyl methacrylate-butadiene copolymers; latexes of acrylic polymers such as acrylic ester and methacrylic ester polymers; latexes of vinyl polymers such as ethylene-vinyl acetate copolymers; functional-group-modified polymer latexes obtained by modifying the above-described binders with a monomer containing a functional group such as a carboxyl group; cationized polymers obtained by cationizing the above-described binders with a cationic group; cationized polymers obtained by cationizing the surfaces of the above-described binders with a cationic surfactant; polymers on the surfaces of which polyvinyl alcohol has been distributed obtained by polymerizing the above-described binders in the presence of cationic polyvinyl alcohol; polymers on the surfaces of which cationic colloid particles have been distributed obtained by polymerizing the above-described binders in a suspended dispersion of the cationic colloid particles; aqueous binders such as thermosetting synthetic resins such as melamine resins and urea resins; polymer or copolymer resins of acrylic esters and methacrylic esters, such as polymethyl methacrylate; and synthetic resin binders such as polyurethane resins, unsaturated polyester resins, vinyl chloride-vinyl acetate copolymers, polyvinyl butyral and alkyd resins. These binders may be used either singly or in any combination thereof. Among these, polyvinyl alcohol is most favorably used as the binder. This polyvinyl alcohol can be synthesized by, for example, hydrolyzing polyvinyl acetate.

The content of the binder is favorably 20.0% by mass or less, more favorably 10.0% by mass or less, based on the pigment from the viewpoint of ink absorbency. The content is favorably 1.0% by mass or more for successfully forming the layer.

A crosslinking agent may be contained in the first layer for enhancing its strength to inhibit the layer from being damaged. Examples of the crosslinking agent include boric acid, boric acid salts and water-soluble zirconium compounds. The content of the crosslinking agent is favorably 1.00% by mass or more, more favorably 1.20% by mass or more, still more favorably 1.30% by mass or more, based on the pigment. The content is favorably 3.00% by mass or less from the viewpoint of ink absorbency.

The absolute dry coating amount of the first layer is 1.0 $g/m^2$ or more from the viewpoint of ink absorbency and favorably 50.0 $g/m^2$ or less from the viewpoint of occurrence of cracking upon drying. In the present invention, the absolute dry coating amount means a coating amount measured upon absolute drying.

Outermost Layer

The outermost layer of the present invention is located at an outermost surface of the recording medium and formed so as to cover the surface of the recording medium. The outermost layer may adjoin the first layer, or a separate layer may be present between these layers. However, the adjoining mode is favorable. The outermost layer is located at an outermost surface of the recording medium, and the surface reflection of the recording medium occurs at an interface between this surface and the air. Therefore, a layer lower in refractive index than the first layer is provided as the outermost layer, whereby the surface reflection can be inhibited to form a sharp image. In short, the outermost layer is lower in refractive index than the first layer.

The outermost layer contains a pigment. No particular limitation is imposed on the pigment so far as it is a pigment capable of making the refractive index of the outermost layer lower than the refractive index of the first layer. Among others, the pigment is favorably a pigment capable of retaining transparency. Examples of the pigment used in the outermost layer include gas phase process silica, wet silica, colloidal silica, gas phase process alumina and alumina hydrate. These pigments may be used either singly or in any combination thereof. Among these, gas phase process silica is particularly favorable in that the refractive index of the pigment itself is low, and a layer high in void content can be formed, and so the refractive index of the outermost layer is made lower than the refractive index of the first layer.

The gas phase process silica in the present invention is a kind of synthetic amorphous silica and also called dry process silica or fumed silica. For example, a process in which a silicon halide is burned together with hydrogen and oxygen, such as a flame hydrolysis process, is generally known. Examples of commercially available gas phase silica include AEROSIL (product of Nippon Aerosil Co., Ltd.) and Reolosil (product of TOKUYAMA Corporation).

The average primary particle size of the gas phase process silica used in the present invention is favorably 15.0 nm or less. The average primary particle size is controlled to 15.0 nm or less, whereby high transparency and void content can be achieved. The average primary particle size is more favorably 7.0 nm or less. Such gas phase process silica is used, whereby scattering of light on the outermost surface can be inhibited to enhance the sharpness of the resulting image. Incidentally, the average primary particle size in the present invention is a value obtained by regarding the diameter of a circle having an area equal to a projected area of each of 100 primary particle present in a certain area, which has been obtained by observation through an electron microscope, as a particle size (equivalent circle size) of the particle and finding the number-average particle size. The specific surface area of the gas phase process silica by the BET method is favorably 200 $m^2/g$ or more, more favorably 300 $m^2/g$ or more. The gas phase process silica favorably has a pore volume of 1.0 ml/g or more for achieving a high void content. The pore volume is more favorably 1.4 ml/g or more.

The gas phase process silica is favorably dispersed in the presence of a dispersant in a coating liquid. As the dispersant, there may be used various dispersants. However, a cationic polymer is favorably used. As the cationic polymer, a cationic polymer having a primary, secondary or tertiary amino group or a quaternary ammonium salt group is favorably used. A poly(diallylamine) derivative is particularly favorably used. The molecular weight of the cationic polymer is favorably 100,000 or less, more favorably 2,000 or more and 50,000 or less, from the viewpoint of dispersion stability of the gas phase process silica.

Examples of a dispersing method include the following method. A gas phase process silica and a dispersion medium are first preliminarily mixed by general propeller agitation, turbine type agitation or homomixer type agitation. The silica is then dispersed by means of a media mill such as ball mill, bead mill or sand grinder, a pressure type disperser such as high pressure homogenizer, an ultrasonic disperser or a thin film spinning type disperser.

The average secondary particle size of the gas phase process silica is favorably 500 nm or less, more favorably 300 nm or less, still more favorably 200 nm or less. The average secondary particle size is favorably 30 nm or more. The average secondary particle size in the present invention is a value measured by the dynamic scattering method and can be determined from analysis using the cumulant method.

The outermost layer favorably contains a binder. The binder is contained, whereby the strength of the resulting layer can be made high. No particular limitation is imposed on a usable binder so far as it does not impair the effects of the present invention. Examples of the binder include the following binders: starch derivatives such as oxidized starch, etherified starch and phosphoric acid-esterified starch; cellulose derivatives such as carboxymethyl cellulose and hydroxyethyl cellulose; casein, gelatin, soybean protein and polyvinyl alcohol and derivatives thereof; polyvinyl pyrrolidone; maleic anhydride resins; latexes of conjugated polymers such as styrene-butadiene copolymers and methyl methacrylate-butadiene copolymers; latexes of acrylic polymers such as acrylic ester and methacrylic ester polymers; latexes of vinyl polymers such as ethylene-vinyl acetate copolymers; functional-group-modified polymer latexes obtained by modifying the above-described polymers with a monomer containing a functional group such as a carboxyl group; cationized polymers obtained by cationizing the above-described polymers with a cationic group; cationized polymers obtained by cationizing the surfaces of the above-described polymers with a cationic surfactant; polymers on the surfaces of which polyvinyl alcohol has been distributed, obtained by polymerizing the above-described polymers in the presence of cationic polyvinyl alcohol; polymers on the surfaces of which cationic colloid particles have been distributed obtained by polymerizing the above-described polymers in a suspended dispersion of the cationic colloid particles; aqueous binders such as thermosetting synthetic resins such as melamine resins and urea resins; polymer or copolymer resins of acrylic esters and methacrylic esters, such as polymethyl methacrylate; and synthetic resin binders such as polyurethane resins, unsaturated polyester resins, vinyl chloride-vinyl acetate copolymers, polyvinyl butyral and alkyd resins. These binders may be used either singly or in any combination thereof. Among these, polyvinyl alcohol is most favorably used as the binder. As this polyvinyl alcohol, may be mentioned ordinary polyvinyl alcohol obtained by hydrolyzing polyvinyl acetate. Polyvinyl alcohol having a viscosity-average polymerization degree of 1,500 or more is favorably used, and that having a viscosity-average polymerization degree of 2,000 or more and 5,000 or less is more favorable. The saponification degree thereof is favorably 80 or more and 100 or less, more favorably 85 or more and 100 or less. The polyvinyl alcohol is favorably used in a state of an aqueous solution, and the dry solid content concentration of polyvinyl alcohol in the aqueous solution is favorably 3.0% by mass or more and 20.0% by mass or less. When the concentration falls within this range, the concentration of a coating liquid can be well prevented from being excessively lowered to greatly lower the drying rate, and to the contrary, the viscosity of the coating liquid can be well prevented from being greatly increased due to excessive increase of the concentration of the coating liquid to impair the smoothness of a coating surface.

The outermost layer favorably contains a binder in an amount of 5.0% by mass or more and 35.0% by mass or less based on the pigment. When the amount is 5.0% by mass or more, the layer can be successfully formed. The binder is favorably contained in an amount of 30.0% by mass or less from the viewpoint of ink absorbency, and the binder is more favorably contained in an amount of 25.0% by mass or less.

The outermost layer may contain a crosslinking agent for enhancing its strength. Examples of the crosslinking agent include boric acid, boric acid salts and water-soluble zirconium compounds. The content of the crosslinking agent is favorably 1.0% by mass or more, more favorably 1.2% by mass or more, still more favorably 1.3% by mass or more, based on the pigment. The content is favorably 3.0% by mass or less from the viewpoint of ink absorbency.

Various kinds of additives may be contained as needed. Examples of additives include fixers such as various kinds of cationic resins, flocculants such as polyvalent metal salts, surfactants, fluorescent whitening agents, thickeners, antifoaming agents, foam inhibitors, parting agents, penetrants, lubricants, ultraviolet absorbents, antioxidants, leveling agents, preservatives, and pH adjustors.

The absolute dry coating amount of the outermost layer is 0.1 $g/m^2$ or more and 0.5 $g/m^2$ or less. When the coating amount is 0.1 g/m$^2$ or more, the effect to reduce reflection can be well developed to well develop sharpness of the resulting image. When the coating amount is 0.5 g/m$^2$ or less, it is inhibited to impair the absorption of an ink by the first layer containing at least one of alumina hydrate and alumina, thereby improving the ink absorbency of a recording medium. The coating amount is favorably 0.3 g/m$^2$ or less.

Other Layers

The recording medium according to the present invention may have another layer (second layer) between the substrate and the first layer. Alternatively, the recording medium may have a further layer (third layer) that does not greatly affect the ink absorption of the first layer between the first layer and the outermost layer. The second and third layers may take the same constitution as the first layer.

Refractive Index

The refractive indexes of the first layer and outermost layer are measured by means of an optical measuring apparatus. As the optical measuring apparatus, is mentioned a spectroellipsometer.

The refractive index of each layer can also be determined as the sum total of values obtained by multiplying refractive indexes of the components in the layer by the respective volume fractions of the components. When the first layer or outermost layer is a porous layer, voids are also added as a constituent component. For example, a case where the constituent components of the first layer are 30% by volume of a pigment having a refractive index of 1.50, 10% by volume of a polymer having a refractive index of 1.30 and 60% by volume of voids (refractive index 1.00) is considered. In this case, the refractive index of the first layer is found to be $1.50\times0.30+1.30\times0.10+1.00\times0.60=1.18$. As described above, the volume fraction of the voids is an important factor in this calculation. This volume fraction varies according to not only the constitution of solid contents in the layer, but also various factors such as a coating method and a drying method. Accordingly, the volume fraction of the voids is calculated from the proportion of an average thickness found by observing a section of a recording medium through an electron microscope to the theoretical film thickness derived from the volumes of the respective components when assuming the volume fraction of voids to be 0. The average thickness of the layer is determined by selecting 20 points from all over the recording medium and averaging the measured values at the 20 points.

The refractive index of the outermost layer is favorably 1.05 or more and 1.20 or less. The refractive index of the first layer is favorably 1.15 or more and 1.35 or less. However, the refractive index of the outermost layer is lower than the refractive index of the first layer as described above.

Production Process of Recording Medium

As a production process of the recording medium according to the present invention, may be mentioned, for example, the following process. A coating liquid for each layer is first prepared by mixing a pigment, a binder, a crosslinking agent, a pH adjustor, various additives and water as needed. These coating liquids are applied on to a substrate or a layer. The coating is conducted by on-machine or off-machine coating using any one of various kinds of curtain coaters, a coater using an extrusion system and a coater using a slide hopper system. Upon the coating, the coating liquid may also be heated for the purpose of adjusting the viscosity of the coating liquid. A coater head may also be heated. For example, a hot air dryer such as a linear tunnel dryer, arch dryer, air loop dryer or sine curve air float dryer may be used for drying of the coating liquid after the coating. An infrared heating dryer or a dryer utilizing microwaves may also be used.

The present invention will hereinafter be described in detail by the following Examples and Comparative Examples. However, the contents of the present invention are not limited to these examples. Incidentally, "parts" or "part" and "%" are based on the mass unless expressly noted.

Substrate

A substrate was prepared under the following conditions. A paper stock of the following composition was first adjusted with water so as to give a solid content of 3.0%.

| | |
|---|---|
| Pulp (80 parts of Laulholz bleached kraft pulp (LBKP) having a freeness of 450 ml CSF (Canadian Criteria Freeness) and 20 parts of Nadelholz bleached kraft pulp (NBKP) having a freeness of 480 ml CSF) | 100 parts |
| Cationized starch | 0.60 parts |
| Ground calcium carbonate | 10 parts |
| Precipitated calcium carbonate | 15 parts |
| Alkyl ketene dimer | 0.10 parts |
| Cationic polyacrylamide | 0.030 parts. |

Paper was then made from this paper stock by a Fourdrinier paper machine, subjected to 3-stage wet pressing and dried by a multi-cylinder dryer. The resultant paper was then impregnated with an aqueous solution of oxidized starch by a size press so as to give a solid content of 1.0 g/m$^2$, and dried. Thereafter, the paper was subjected to machine calender finishing to prepare base paper A having a basis weight of 170 g/m$^2$, a Stöckigt sizing degree of 100 seconds, a gas permeability of 50 seconds, a Bekk smoothness of 30 seconds and a Gurley stiffness of 11.0 mN.

A resin composition composed of low density polyethylene (70 parts), high density polyethylene (20 parts) and titanium oxide (10 parts) was applied in an amount of 25 g/m$^2$ on the base paper A. A resin composition composed of high density polyethylene (50 parts) and low density polyethylene (50 parts) was further applied in an amount of 25 g/m$^2$ on a back side of the base paper A, thereby preparing a resin-coated substrate.

Preparation of Alumina Hydrate Dispersion 1

To 333 parts of ion-exchanged water, was added 1.65 parts of methanesulfonic acid as a deflocculating acid. While this aqueous solution of methanesulfonic acid was stirred under rotating conditions of 3,000 rpm with a homomixer (trade name: T.K. Homomixer MARK 112.5 Type, manufactured by Tokushu Kika Kogyo Co., Ltd.,), 100 parts of alumina hydrate (trade name: DISPERAL HP14, product of Sasol Co.) was gradually added. The stirring was continued for 30 minutes even after completion of the addition, thereby preparing an alumina hydrate dispersion 1 having a solid content concentration of 23%.

Preparation of Alumina Dispersion 1

To 333 parts of ion-exchanged water, was added 1.65 parts of methanesulfonic acid as a deflocculating acid. While this aqueous solution of methanesulfonic acid was stirred under rotating conditions of 3,000 rpm with a homomixer (trade name: T.K. Homomixer MARK 112.5 Type, manufactured by Tokushu Kika Kogyo Co., Ltd.,), 100 parts of gas phase process γ-alumina (trade name: Aeroxide Alu C, product of Evonik Co.) was gradually added. The stirring was continued for 30 minutes even after completion of the addition, thereby preparing an alumina dispersion 1 having a solid content concentration of 23%.

Preparation of Cationic Emulsion

A cationic emulsion was prepared in the following manner. A reaction vessel equipped with a stirrer, a thermometer and a reflux condenser was charged with 109 g of acetone as a reaction solvent. Under stirring, 40.00 g of 3,6-dithia-1,8-octanediol and 6.79 g of methyldiethanol-amine were dissolved, the resultant solution was heated to 40° C., and 62.07 g of isophorone diisocyanate was added. Thereafter, the resultant mixture was heated to 50° C., 0.2 g of a tin catalyst was added, and the mixture was heated further to 55° C. to conduct a reaction for 4 hours with stirring. After completion of the reaction, the reaction mixture was cooled to room temperature, and 3.09 g of 85% formic acid was added to cationize a reaction product. After 446 g of water was additionally added, the resultant mixture was concentrated under reduced pressure to remove acetone, and the concentration of the mixture was adjusted with water, thereby preparing a cationic emulsion 1 having a solid content of 20%. The average particle size of the resultant cationic emulsion 1 was measured by means of a laser particle size analysis system, PAR III (trade name; manufactured by OTSUKA ELECTRONICS Co., Ltd.). As a result, the average particle size was 50 nm.

Preparation of Gas Phase Process Silica Dispersion 1

In a suction type disperser stirrer, Conti-TDS, 5 parts of a dimethyldiallylammonium chloride homopolymer (trade name: SHALLOL DC902P, product of DAI-ICHI KOGYO SEIYAKU CO., LTD.) was added to 420 parts of ion-exchanged water. In addition, 100 parts of gas phase process silica (trade name: AEROSIL 300, product of Nippon Aerosil Co., Ltd.) was gradually added at a maximum revolving speed, and dispersion was conducted for 24 hours to prepare a gas phase process silica dispersion 1 having a solid content concentration of 20%.

Preparation of Gas Phase Process Silica Dispersion 2

In a suction type disperser stirrer, Conti-TDS, 5 parts of a dimethyldiallylammonium chloride homopolymer (trade name: SHALLOL DC902P, product of DAI-ICHI KOGYO SEIYAKU CO., LTD.) was added to 420 parts of ion-exchanged water. In addition, 100 parts of gas phase process silica (trade name: AEROSIL 200, product of Nippon Aerosil Co., Ltd.) was gradually added at a maximum revolving speed, and dispersion was conducted for 24 hours to prepare a gas phase process silica dispersion 2 having a solid content concentration of 20%.

Preparation of Coating Liquid

Respective coating liquids were prepared according to the following respective compositions. Incidentally, in each composition of the coating liquids, the amounts (parts) of components are shown with the total solid content of pigments regarded as 100 parts.

Coating Liquid 1 for First Layer

| | |
|---|---|
| Alumina hydrate dispersion 1 | 435 parts |
| Aqueous polyvinyl alcohol solution (PVA 235, product of Kuraray Co., Ltd., weight-average polymerization degree: 3,500, saponification degree: 88% by mol, solid content: 8%) | 112.5 parts |
| Aqueous orthoboric acid solution (solid content: 5%) | 23 parts. |

Coating Liquid 2 for First Layer

| | |
|---|---|
| Alumina hydrate dispersion 1 | 348 parts |
| Alumina dispersion 1 | 87 parts |
| Cationic polyurethane emulsion | 15 parts |

-continued

| | |
|---|---|
| Aqueous polyvinyl alcohol solution (PVA 235, product of Kuraray Co., Ltd., weight-average polymerization degree: 3,500, saponification degree: 88% by mol, solid content: 8%) | 112.5 parts |
| Surfactant (Surfynol 465, product of Nisshin Chemical Industry Co., Ltd.) | 0.7 parts |
| Zirconyl acetate (Zircosol ZA-30, product of Daiichi Kigenso Kagaku Kogyo Co., Ltd., solid content: 30%) | 0.67 parts |
| Aqueous orthoboric acid solution (solid content: 5%) | 23 parts. |

Coating Liquid 3 for First Layer

| | |
|---|---|
| Gas phase process silica dispersion 1 | 500 parts |
| Cationic polyurethane emulsion | 15 parts |
| Aqueous polyvinyl alcohol solution (PVA 235, product of Kuraray Co., Ltd., weight-average polymerization degree: 3,500, saponification degree: 88% by mol, solid content: 8%) | 250 parts |
| Surfactant (Surfynol 465, product of Nisshin Chemical Industry Co., Ltd.) | 0.7 parts |
| Zirconyl acetate (Zircosol ZA-30, product of Daiichi Kigenso Kagaku Kogyo Co., Ltd., solid content: 30%) | 3.33 parts |
| Aqueous orthoboric acid solution (solid content: 5%) | 60 parts. |

Coating Liquid 1 for Second Layer

| | |
|---|---|
| Alumina hydrate dispersion 1 | 435 parts |
| Aqueous polyvinyl alcohol solution (PVA 235, product of Kuraray Co., Ltd., weight-average polymerization degree: 3,500, saponification degree: 88% by mol, solid content: 8%) | 112.5 parts |
| Zirconyl acetate (Zircosol ZA-30, product of Daiichi Kigenso Kagaku Kogyo Co., Ltd., solid content: 30%) | 1.67 parts |
| Aqueous orthoboric acid solution (solid content: 5%) | 40 parts. |

Coating Liquid 2 for Second Layer

| | |
|---|---|
| Alumina hydrate dispersion 1 | 435 parts |
| Aqueous polyvinyl alcohol solution (PVA 235, product of Kuraray Co., Ltd., weight-average polymerization degree: 3,500, saponification degree: 88% by mol, solid content: 8%) | 112.5 parts |
| Aqueous orthoboric acid solution (solid content: 5%) | 23 parts. |

Coating Liquid 3 for Second Layer

| | |
|---|---|
| Gas phase process silica dispersion 1 | 525 parts |
| Aqueous polyvinyl alcohol solution (PVA 235, product of Kuraray Co., Ltd., weight-average polymerization degree: 3,500, saponification degree: 88% by mol, solid content: 8%) | 250 parts |
| Zirconyl acetate (Zircosol ZA-30, product of Daiichi Kigenso Kagaku Kogyo Co., Ltd., solid content: 30%) | 0.67 parts |
| Aqueous orthoboric acid solution (solid content: 5%) | 80 parts. |

Coating Liquid 1 for Outermost Layer

A coating liquid 1 for outermost layer was prepared according to the following composition.

| | |
|---|---|
| Gas phase process silica dispersion 1 | 525 parts |
| Aqueous polyvinyl alcohol solution (PVA 235, product of Kuraray Co., Ltd., weight-average polymerization degree: 3,500, saponification degree: 88% by mol, solid content: 8%) | 250 parts |
| Surfactant (Surfynol 465, product of Nisshin Chemical Industry Co., Ltd.) | 0.75 parts |
| Aqueous orthoboric acid solution (solid content: 5%) | 80 parts. |

Finally, ion-exchanged water was added to adjust the solid content concentration in the coating liquid to 12.5%.

Coating Liquid 2 for Outermost Layer

A coating liquid 2 for outermost layer was prepared according to the following composition.

| | |
|---|---|
| Gas phase process silica dispersion 2 | 525 parts |
| Aqueous polyvinyl alcohol solution (PVA 235, product of Kuraray Co., Ltd., weight-average polymerization degree: 3,500, saponification degree: 88% by mol, solid content: 8%) | 250 parts |
| Surfactant (Surfynol 465, product of Nisshin Chemical Industry Co., Ltd.) | 0.75 parts |
| Aqueous orthoboric acid solution (solid content: 5%) | 80 parts. |

Finally, ion-exchanged water was added to adjust the solid content concentration in the coating liquid to 12.5%.

Example 1

The coating liquid 1 for first layer and the coating liquid 1 for outermost layer were applied on a front side of the substrate by a multi-layer slide hopper type coater to form 2 layers in total in such a manner that a lower layer and an upper layer become a first layer and an outermost layer, respectively. The absolute dry coating amounts of the first and outermost layers were controlled to 35.0 g/m$^2$ and 0.1 g/m$^2$, respectively. The substrate was then dried at 60° C. by means of a hot air dryer to prepare Recording Medium A-1.

Example 2

Recording Medium A-2 was prepared in the same manner as in Recording Medium A-1 except that the absolute dry coating amount of the outermost layer was changed to 0.2 g/m$^2$.

Example 3

Recording Medium A-3 was prepared in the same manner as in Recording Medium A-1 except that the absolute dry coating amount of the outermost layer was changed to 0.3 g/m$^2$.

Example 4

Recording Medium A-4 was prepared in the same manner as in Recording Medium A-1 except that the absolute dry coating amount of the outermost layer was changed to 0.5 g/m$^2$.

Example 5

Recording Medium A-5 was prepared in the same manner as in Recording Medium A-2 except that the amount of the aqueous polyvinyl alcohol solution added into the coating liquid 1 for outermost layer was changed to 325 parts.

Example 6

Recording Medium A-6 was prepared in the same manner as in Recording Medium A-2 except that the amount of the aqueous polyvinyl alcohol solution added into the coating liquid 1 for outermost layer was changed to 388 parts.

Example 7

Recording Medium A-7 was prepared in the same manner as in Recording Medium A-2 except that the amount of the aqueous polyvinyl alcohol solution added into the coating liquid 1 for outermost layer was changed to 188 parts.

Example 8

Recording Medium A-8 was prepared in the same manner as in Recording Medium A-2 except that the amount of the aqueous polyvinyl alcohol solution added into the coating liquid 1 for outermost layer was changed to 125 parts.

Example 9

Recording Medium A-9 was prepared in the same manner as in Recording Medium A-2 except that the coating liquid 1 for outermost layer was changed to the coating liquid 2 for outermost layer.

Example 10

The coating liquid 1 for second layer, the coating liquid 2 for first layer and the coating liquid 1 for outermost layer were applied on a front side of the substrate by a multi-layer slide hopper type coater in such a manner that a second layer, a first layer and an outermost layer are formed in that order. The absolute dry coating amounts of the second, first and outermost layers were controlled to 25.0 g/m$^2$, 10.0 g/m$^2$ and 0.2 g/m$^2$, respectively. The substrate was then dried at 60° C. by means of a hot air dryer to prepare Recording Medium A-10.

Example 11

Recording Medium A-11 was prepared in the same manner as in Recording Medium A-10 except that the amount of zirconyl acetate added in the composition of the coating liquid 2 for first layer was changed to 0.17 parts.

Example 12

Recording Medium A-12 was prepared in the same manner as in Recording Medium A-10 except that the coating liquid 1 for second layer and the coating liquid 2 for first layer in Recording Medium 10 were changed to the coating liquid 2 for second layer and the coating liquid 1 for first layer, respectively.

Comparative Example 1

Recording Medium A-13 was prepared in the same manner as in Recording Medium A-1 except that no outermost layer was provided.

Comparative Example 2

Recording Medium A-14 was prepared in the same manner as in Recording Medium A-1 except that the absolute dry coating amount of the outermost layer was changed to 0.7 $g/m^2$.

Comparative Example 3

Recording Medium A-15 was prepared in the same manner as in Recording Medium A-2 except that spherical colloidal silica sol (trade name: Snowtex O, product of Nissan Chemical Industries, Co. Ltd.) was used in place of the gas phase process silica dispersion 1 in the coating liquid 1 for outermost layer.

Comparative Example 4

Recording Medium A-16 was prepared in the same manner as in Recording Medium A-2 except that non-spherical colloidal silica sol (trade name: Snowtex OUP, product of Nissan Chemical Industries, Co. Ltd.) was used in place of the gas phase process silica dispersion 1 in the coating liquid 1 for outermost layer.

Comparative Example 5

Recording Medium A-17 was prepared in the same manner as in Recording Medium A-10 except that the coating liquid 2 for first layer and the coating liquid 1 for second layer were changed to the coating liquid 3 for first layer and the coating liquid 3 for second layer, respectively.

Evaluating Method

The respective recording media were subjected to the following evaluations.

Sharpness of Black

A black solid image was printed on each of the respective recording media with "platinum mode" (default setting) of an ink jet printer (trade name: PIXUS MP980, manufactured by Canon Inc.). After the resultant print was dried for a day, the image was subjected to reflection measurement by the SCI system using a spectrophotometer (CMS-35SP, manufactured by MURAKAMI COLOR RESEARCH LABORATORY CO., LTD.) to measure a Y value. The Y value measured was ranked on the basis of the following criteria.

AA: Less than 1.6,

A: 1.6 or more and less then 1.8,

B: 1.8 or more and less than 2.0,

C: 2.0 or more and less than 2.2,

D: 2.0 or more.

Ink Absorbency

The ink absorbency of each of the respective recording media was evaluated. Printing was conducted by means of an apparatus obtained by modifying the printing process of iP4600 (trade name, manufactured by Canon Inc.). As a print pattern, was used a green 64-gradation solid print (64 gradations with an increment of 6.25% duty, 0 to 400% duty). Specifically, 64 1-square inch solid images different in duty from 0% to 400% with an increment of 6.25% were formed. Each solid image was formed by bi-directional printing in which printing is completed by reciprocating 2-pass scans at a carriage speed of 25 in/sec. Incidentally, the 400% duty means that 44 ng of an ink is applied to a 1/600 square inch using an ink jet head the resolution of which is 600 dpi. Since the ink absorbency has a correlation with beading, the beading was evaluated, whereby the ink absorbency of the recording medium was evaluated. The beading means such a phenomenon that an ink droplet applied to the surface comes into contact with an adjoining ink droplet before absorbed in an ink receiving layer to form an image having color unevenness. The evaluation was visually made to determine the rank of the recording medium based on the following evaluation criteria.

AA: No beading was observed even at 300% duty,

A: Beading is somewhat observed in a range of 250% duty or more and 300% duty or less, but no beading is observed at less than 250% duty, B: Beading is somewhat observed in a range of 200% duty or more and 250% duty or less, but no beading is observed at less than 200% duty, C: Beading is observed even at less than 200% duty.

Resistance to Roller Mark

Each of the recording media of Examples 1 to 12 was stored for 6 hours under a high-humidity environment of 30° C. and 80% relative humidity. Thereafter, a black solid image was printed on the recording medium with "platinum mode" (default setting) of an ink jet recording apparatus (trade name: PIXUS MP980, manufactured by Canon Inc.). Marks on a roller-passed portion of the surface of the print was visually evaluated on the basis of the following criteria to determine the rank.

AA: No roller mark was observed,

A: One roller mark was observed,

B: Plural roller marks were observed.

The results of the above-described evaluations are shown in Table 1. Incidentally, "Average primary particle size" in Table 1 is number-average particle size of equivalent circle sizes. The refractive indexes of the outermost layer and first layer are values measured by the following method performed separately from the operation of each Example. First, a coating liquid for each layer was applied on a substrate prepared so as to give an absolute dry coating amount of 20.0 $g/m^2$. After drying of the coating, measurement was conducted at a wavelength of 589 nm by means of a spectroellipsometer (trade name: M-2000V, manufactured by J.A. Woollam Japan Co., Ltd.). In this manner, the refractive indexes of the outermost layer and first layer were measured.

TABLE 1

| | | Outermost layer | | | | | First layer | |
|---|---|---|---|---|---|---|---|---|
| | | Pigment | | Content | | | | Content |
| | Recording medium | Pigment | Average primary particle size (nm) | of binder (% by mass based on pigment) | Absolute dry coating amount (g/m$^2$) | Average refractive index | Pigment | of binder (% by mass based on pigment) |
| Ex. 1 | A-1 | Gas phase process silica | 7.0 | 20.0 | 0.1 | 1.17 | Alumina hydrate | 9.0 |
| Ex. 2 | A-2 | Gas phase process silica | 7.0 | 20.0 | 0.2 | 1.17 | Alumina hydrate | 9.0 |
| Ex. 3 | A-3 | Gas phase process silica | 7.0 | 20.0 | 0.3 | 1.17 | Alumina hydrate | 9.0 |
| Ex. 4 | A-4 | Gas phase process silica | 7.0 | 20.0 | 0.5 | 1.17 | Alumina hydrate | 9.0 |
| Ex. 5 | A-5 | Gas phase process silica | 7.0 | 26.0 | 0.2 | 1.17 | Alumina hydrate | 9.0 |
| Ex. 6 | A-6 | Gas phase process silica | 7.0 | 31.0 | 0.2 | 1.17 | Alumina hydrate | 9.0 |
| Ex. 7 | A-7 | Gas phase process silica | 7.0 | 15.0 | 0.2 | 1.17 | Alumina hydrate | 9.0 |
| Ex. 8 | A-8 | Gas phase process silica | 7.0 | 10.0 | 0.2 | 1.17 | Alumina hydrate | 9.0 |
| Ex. 9 | A-9 | Gas phase process silica | 12.0 | 20.0 | 0.2 | 1.17 | Alumina hydrate | 9.0 |
| Ex. 10 | A-10 | Gas phase process silica | 7.0 | 20.0 | 0.2 | 1.17 | Alumina hydrate/ alumina | 9.0 |
| Ex. 11 | A-11 | Gas phase process silica | 7.0 | 20.0 | 0.2 | 1.17 | Alumina hydrate/ alumina | 9.0 |
| Ex. 12 | A-12 | Gas phase process silica | 7.0 | 20.0 | 0.2 | 1.17 | Alumina hydrate | 9.0 |
| Comp. Ex. 1 | A-13 | — | — | — | 0 | — | Alumina hydrate | 9.0 |
| Comp. Ex. 2 | A-14 | Gas phase process silica | 7.0 | 20.0 | 0.7 | 1.17 | Alumina hydrate | 9.0 |
| Comp. Ex. 3 | A-15 | Spherical colloidal silica | 15.0 | 20.0 | 0.2 | 1.32 | Alumina hydrate | 9.0 |
| Comp. Ex. 4 | A-16 | Non-spherical colloidal silica | — | 20.0 | 0.2 | 1.29 | Alumina hydrate | 9.0 |
| Comp. Ex. 5 | A-17 | Gas phase process silica | 7.0 | 20.0 | 0.2 | 1.17 | Gas phase process silica | 20.0 |

| | | First layer | | | | Evaluation | | |
|---|---|---|---|---|---|---|---|---|
| | | Crosslinking agent | | | | | | |
| | Recording medium | Boric acid or borate (% by mass based on pigment) | Water-soluble Zr salt (% by mass based on pigment) | refractive index | Second layer | Sharpness of black | Ink absorbency | Roller mark |
| Ex. 1 | A-1 | 1.15 | — | 1.23 | — | AA | AA | B |
| Ex. 2 | A-2 | 1.15 | — | 1.23 | — | AA | AA | B |
| Ex. 3 | A-3 | 1.15 | — | 1.23 | — | AA | AA | B |
| Ex. 4 | A-4 | 1.15 | — | 1.23 | — | AA | A | B |

TABLE 1-continued

| | | | | | | | | |
|---|---|---|---|---|---|---|---|---|
| Ex. 5 | A-5 | 1.15 | — | 1.23 | — | AA | A | B |
| Ex. 6 | A-6 | 1.15 | — | 1.23 | — | AA | B | B |
| Ex. 7 | A-7 | 1.15 | — | 1.23 | — | AA | AA | B |
| Ex. 8 | A-8 | 1.15 | — | 1.23 | — | AA | AA | B |
| Ex. 9 | A-9 | 1.15 | — | 1.23 | — | A | AA | B |
| Ex. 10 | A-10 | 1.15 | 0.20 | 1.23 | Formed with coating liquid 1 | AA | AA | AA |
| Ex. 11 | A-11 | 1.15 | 0.05 | 1.23 | Formed with coating liquid 1 | AA | AA | A |
| Ex. 12 | A-12 | 1.15 | — | 1.23 | Formed with coating liquid 2 | AA | AA | B |
| Comp. Ex. 1 | A-13 | 1.15 | — | 1.23 | — | B | AA | — |
| Comp. Ex. 2 | A-14 | 1.15 | — | 1.23 | — | AA | C | — |
| Comp. Ex. 3 | A-15 | 1.15 | — | 1.23 | — | D | C | — |
| Comp. Ex. 4 | A-16 | 1.15 | — | 1.23 | — | C | B | — |
| Comp. Ex. 5 | A-17 | 3.00 | 0.10 | 1.17 | Formed with coating liquid 3 | A | B | — |

The recording medium of Comparative Example 1, in which no outermost layer was provided, was poor in sharpness of black. Comparative Example 2, in which the coating amount of the outermost layer was large, was poor in ink absorbency. The recording media of Comparative Examples 3 and 4, in which the refractive index of the outermost layer was higher than the refractive index of the first layer, was poor in sharpness of black. The recording medium of Comparative Example 5, in which the refractive index of the outermost layer was equal to the refractive index of the first layer, was somewhat good in sharpness of black but poor in ink absorbency because the first layer contained the binder in a high proportion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-125238, filed May 31, 2010, which is hereby incorporated by reference herein in its entirety.

What is claimed is:

1. A recording medium, comprising:

a substrate; and a first layer and an outermost layer provided on the substrate in this order, wherein the first layer comprises (a) alumina, (b) alumina hydrate, or (c) alumina and alumina hydrate, wherein the outermost layer comprises a pigment, wherein the outermost layer is lower in refractive index than the first layer, wherein the absolute dry coating amount of the outermost layer is 0.1 $g/m^2$ to 0.5 $g/m^2$, and wherein the pigment is gas phase process silica.

2. The recording medium according to claim 1, wherein the outermost layer further comprises a binder in the amount of 30.0% by mass or less based on the pigment.

3. The recording medium according to claim 1, wherein the average primary particle size of the pigment is 7.0 nm or less.

* * * * *